US008092617B2

(12) United States Patent
Kramer et al.

(10) Patent No.: US 8,092,617 B2
(45) **Date of Patent: *Jan. 10, 2012**

(54) COMPOSITION AND PROCESSES OF A DRY-IN-PLACE TRIVALENT CHROMIUM CORROSION-RESISTANT COATING FOR USE ON METAL SURFACES

(75) Inventors: Kirk Kramer, West Bloomfield, MI (US); Lisa Salet, Sterling Heights, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/674,339

(22) Filed: Feb. 13, 2007

(65) Prior Publication Data

US 2007/0187001 A1 Aug. 16, 2007

Related U.S. Application Data

(60) Provisional application No. 60/773,290, filed on Feb. 14, 2006.

(51) Int. Cl.
*C23C 22/48* (2006.01)

(52) U.S. Cl. ..... 148/247

(58) Field of Classification Search ..... 148/247
See application file for complete search history.

(56) References Cited

U.S. PATENT DOCUMENTS

| | | | | |
|---|---|---|---|---|
| 3,932,198 | A * | 1/1976 | Schneider | 148/265 |
| 4,084,014 | A | 4/1978 | Fabregas | |
| 4,169,741 | A | 10/1979 | Lampatzer et al. | |
| 4,171,231 | A * | 10/1979 | Bishop et al. | 148/258 |
| 4,183,772 | A | 1/1980 | Davis | |
| 4,266,988 | A | 5/1981 | Krippes | |
| 4,540,733 | A | 9/1985 | Ito et al. | |
| 4,644,029 | A | 2/1987 | Cable et al. | |
| 4,647,316 | A | 3/1987 | Prescott | |
| 4,705,821 | A | 11/1987 | Ito et al. | |
| 4,761,189 | A | 8/1988 | Mady et al. | |
| 4,801,337 | A | 1/1989 | Higgins | |
| 4,956,027 | A | 9/1990 | Saeki et al. | |
| 4,963,198 | A | 10/1990 | Higgins | |
| 4,966,634 | A | 10/1990 | Saeki et al. | |
| 4,992,116 | A | 2/1991 | Hallman | |
| 5,000,799 | A | 3/1991 | Miyawaki | |
| 5,039,360 | A | 8/1991 | Brugarolas et al. | |
| 5,045,130 | A | 9/1991 | Gosset et al. | |
| 5,073,196 | A | 12/1991 | Fotinos et al. | |
| 5,082,511 | A | 1/1992 | Farina et al. | |
| 5,089,064 | A | 2/1992 | Reghi | |
| 5,091,023 | A | 2/1992 | Saeki et al. | |
| 5,125,989 | A | 6/1992 | Hallman | |
| 5,141,575 | A | 8/1992 | Yoshitake et al. | |
| 5,143,562 | A | 9/1992 | Boulos | |
| 5,242,714 | A | 9/1993 | Steele et al. | |
| 5,261,973 | A | 11/1993 | Sienkowski et al. | |
| 5,268,042 | A | 12/1993 | Carlson | |
| 5,281,282 | A | 1/1994 | Dolan et al. | |
| 5,298,092 | A | 3/1994 | Schriever | |
| 5,304,257 | A | 4/1994 | Pearlstein et al. | |
| 5,308,709 | A | 5/1994 | Ogino et al. | |
| 5,318,640 | A | 6/1994 | Ishii et al. | |
| 5,321,061 | A | 6/1994 | Anderson et al. | |
| 5,342,456 | A | 8/1994 | Dolan | |
| 5,342,556 | A | 8/1994 | Traubel et al. | |
| 5,356,490 | A | 10/1994 | Dolan | |
| 5,366,567 | A | 11/1994 | Ogino et al. | |
| 5,374,347 | A | 12/1994 | Pearlstein et al. | |
| 5,378,291 | A | 1/1995 | Ara et al. | |
| 5,378,292 | A | 1/1995 | Miller et al. | |
| 5,378,392 | A | 1/1995 | Murashiro et al. | |
| 5,391,239 | A | 2/1995 | Boulos | |
| 5,393,354 | A | 2/1995 | Bishop | |
| 5,395,655 | A * | 3/1995 | Kazuyuki et al. | 427/388.4 |
| 5,399,209 | A | 3/1995 | Suda et al. | |
| 5,407,749 | A | 4/1995 | Bishop | |
| 5,411,606 | A | 5/1995 | Schriever | |
| 5,415,687 | A | 5/1995 | Schriever et al. | |
| 5,415,702 | A | 5/1995 | Bishop et al. | |
| 5,427,623 | A | 6/1995 | Schumann et al. | |
| 5,427,632 | A | 6/1995 | Dolan | |
| 5,449,414 | A | 9/1995 | Dolan | |
| 5,449,415 | A | 9/1995 | Dolan | |
| 5,451,271 | A | 9/1995 | Yoshida et al. | |

(Continued)

FOREIGN PATENT DOCUMENTS

| | | | |
|---|---|---|---|
| JP | 61-000587 | A | 1/1986 |
| JP | 07-126859 | A | 5/1995 |
| JP | 11-335865 | A | 12/1999 |
| WO | WO99/08806 | A1 | 2/1999 |
| WO | WO02/055758 | A2 | 7/2002 |
| WO | WO03/040431 | A2 | 5/2003 |
| WO | WO03/040437 | A1 | 5/2003 |
| WO | WO2005/056876 | A1 | 6/2005 |
| WO | WO2006/088519 | A2 | 8/2006 |
| WO | WO2006/128154 | A1 | 11/2006 |

OTHER PUBLICATIONS

International Search Report dated Jul. 6, 2007, International Application PCT/US2007/062026.

Written Opinion dated Jul. 6, 2007, International Application PCT/US2007/062026.

International Search Report dated Sep. 20, 2007, International Application PCT/US2007/068640.

Written Opinion dated Sep. 20, 2007, International Application PCT/US2007/068640.

*Primary Examiner* — Melvin Mayes
*Assistant Examiner* — Stefanie Cohen
(74) *Attorney, Agent, or Firm* — Mary K. Cameron

(57) ABSTRACT

Corrosion resistant coatings are formed on aluminum by contacting with aqueous solutions containing trivalent chromium ions and fluorometallate ions, the solutions being substantially free of hexavalent chromium. Trivalent chromium films formed on the aluminum surface when tested in 5% NaCl salt spray chamber showed corrosion resistance in excess of 168 hours. Trivalent chromium coated aluminum also serves as an effective base for paint primers.

18 Claims, No Drawings

U.S. PATENT DOCUMENTS 5,452,884 A 9/1995 Gugsch et al.
5,454,882 A 10/1995 Asai et al.
5,472,522 A 12/1995 Kawaguchi et al.
5,472,524 A 12/1995 Schiever
5,487,949 A 1/1996 Schiever
5,498,300 A 3/1996 Aoki et al.
5,498,759 A 3/1996 Najada et al.
5,507,084 A 4/1996 Richter
5,507,884 A 4/1996 Ogino et al.
5,534,082 A 7/1996 Dollman et al.
5,551,994 A 9/1996 Schriever
5,595,611 A 1/1997 Boulos et al.
5,645,650 A 7/1997 Ishizaki et al.
5,683,816 A 11/1997 Goodreau
5,700,334 A 12/1997 Ishii et al.
5,700,561 A 12/1997 Mano et al.
5,702,759 A 12/1997 White et al.
5,769,667 A 6/1998 Belopolsky
5,769,967 A 6/1998 Dolan
5,807,442 A 9/1998 Goodreau
5,851,371 A 12/1998 Steinbrecher et al.
5,859,095 A 1/1999 Moyle et al.
5,958,511 A 9/1999 Dolan
6,010,263 A 1/2000 White et al.
6,096,140 A 8/2000 Susa et al.
6,099,714 A 8/2000 Bibber
6,149,735 A 11/2000 Oue et al.
6,248,181 B1 6/2001 Osako et al.
6,294,262 B1 9/2001 Fukuoka
6,361,622 B1 * 3/2002 McCormick et al. ..... 148/247
6,375,726 B1 * 4/2002 Matzdorf et al. ..... 106/14.44
6,511,532 B2 1/2003 Matzdorf et al.
6,521,029 B1 2/2003 Matzdorf et al.
6,527,841 B2 3/2003 Matzdorf et al.
6,596,062 B2 7/2003 Chung et al.
RE38,285 E 10/2003 Susa et al.
6,648,986 B1 11/2003 Tang et al.
6,663,700 B1 12/2003 Matzdorf et al.
6,669,764 B1 12/2003 Matzdorf et al.
6,706,123 B2 3/2004 Fristad et al.
6,723,178 B1 4/2004 Bannai et al.
6,887,321 B2 * 5/2005 Parkos et al. ..... 148/264
7,018,486 B2 3/2006 Bhatia
RE40,406 E 7/2008 McCormick et al.
2003/0027011 A1 2/2003 Kotov et al.
2003/0145909 A1 8/2003 Diaddario, Jr. et al.
2005/0109426 A1 5/2005 Inoue et al.
2005/0194574 A1 9/2005 Yamamuro et al.
2006/0116537 A1 6/2006 Cuzzato
2006/0180247 A1 8/2006 Matzdorf et al.
2006/0191599 A1 8/2006 Matzdorf et al.
2006/0237098 A1 10/2006 Matzdorf et al.
2006/0240191 A1 10/2006 Matzdorf et al.

* cited by examiner

COMPOSITION AND PROCESSES OF A DRY-IN-PLACE TRIVALENT CHROMIUM CORROSION-RESISTANT COATING FOR USE ON METAL SURFACES

CROSS REFERENCE TO RELATED APPLICATION

This application claims priority from U.S. Provisional Application No. 60/773,290 filed Feb. 14, 2006.

FIELD OF THE INVENTION

This invention relates to a method of treating metal surfaces to enhance corrosion resistance and paint bonding characteristics and relates to trivalent chromium coatings for aluminum and aluminum alloys used in such processes, which are substantially or entirely free of hexavalent chromium. More particularly, this invention relates to an aqueous composition, suitable for use as a dry-in-place coating for metal, that comprises trivalent chromium cations, fluorometallate anions, their corresponding counterions, and other optional components, and methods for using same.

BACKGROUND OF THE INVENTION

It is generally known to treat the surfaces of metals, such as zinc, cadmium, or aluminum with aqueous hexavalent chromium solutions which contain chemicals that dissolve the surface of the metal and form insoluble films known as "chromate conversion coatings." These coatings, which contain hexavalent chromium, are corrosion resistant and protect the metal from various elements which cause corrosion. In addition, it is known that hexavalent chromate conversion coatings generally have good paint bonding characteristics and, therefore, provide an excellent base for paint or other finishes.

Although the aforementioned coatings enhance corrosion resistance and paint bonding properties, the coatings have a serious drawback, i.e., the toxic nature of the hexavalent chromium constituent. This is a serious problem from two viewpoints, one being the handling of the solution by operators and the other, the disposal of the used solution. Therefore, it is highly desirable to have coatings which are free of, or substantially free of, hexavalent chromium, but at the same time capable of imparting corrosion resistance and paint bonding properties which are comparable to those imparted by conventional hexavalent chromium coatings.

Of particular interest is the use of hexavalent chromate conversion coatings on aircraft aluminum alloys due to the excellent corrosion resistance and the ability to serve as an effective base for paint. The baths used to develop these coatings contain hexavalent chromates, and it is the residual hexavalent chromates in the coating that is largely responsible for the high degree of corrosion inhibition. However, these same hexavalent chromates are toxic and their presence in waste water effluents is severely restricted. It would, therefore, be desirable to provide a composition for coating aluminum and its alloys, and for sealing of anodized aluminum, utilizing less hazardous chemicals that could serve as an alternative to the toxic hexavalent chromate coatings. There has been a significant unmet need in the coating industry to provide conversion coatings that contain little or no hexavalent chromium, but which still provide corrosion resistance and paint bonding that is comparable to the prior art hexavalent chromium containing conversion coatings.

SUMMARY OF THE INVENTION

It is therefore an object of this invention to provide a novel chromium-containing solution for treating aluminum, including anodized aluminum, wherein said solution contains no or substantially no hexavalent chromium, but provides performance comparable to the hexavalent chromium containing conversion coatings.

It is another object of this invention to provide a composition for treating aluminum which contains chromium only in the trivalent oxidation state. Preferably, the composition contains substantially no zinc, meaning, no zinc other than trace amounts found in the raw materials or substrate to be coated. Most preferably no heavy metals, other than the trivalent chromium and those found in the fluorometallates, e.g. fluorozirconate, fluorotitanate and the like, are present in more than such trace amounts, that is substantially no other heavy metals.

It is still another object of this invention to provide a trivalent chromium-containing solution wherein the trivalent chromium has little or no tendency to precipitate, preferably forming no Cr (III)-containing precipitate, during storage but reacts with metal substrates to form a trivalent chromium-containing coating on the metal substrate surface. That is, a composition wherein the Cr (III) is stable in solution.

It is an object of the invention to provide compositions for treating a metal surface comprising a component of fluorometallate anions; a component of chromium(III) cations; and, optionally, one or more of the following components: a component of free fluoride ions; a component of surfactant molecules; a pH adjusting component and a viscosity increasing component.

It is an object of this invention to provide a composition for coating or touching-up or both coating and touching-up a metal surface, the composition comprising water and:

(A) from about 4.5 millimoles per kilogram to about 27 millimoles per kilogram of a component of fluorometallate anions and mixtures of fluorometallate anions, each of the anions comprising:

(i) at least four fluorine atoms; and (ii) at least one atom of an element selected from the group consisting of titanium, zirconium, hafnium, silicon, aluminum, and boron, and, optionally, one or both of (iii) at least one ionizable hydrogen atom; and (iv) at least one oxygen atom; and (B) from about 3.8 g/l to about 46 g/l of trivalent chromium cations; the composition being substantially free of hexavalent chromium. Desirably, the fluorometallate anions are selected from the group consisting of fluorosilicate, fluorotitanate, and fluorozirconate anions, and mixtures thereof.

In one embodiment, the fluorometallate anions include fluorozirconate anions in a concentration within a range from about 5.1 to about 24 mM/kg. In another embodiment, the liquid composition may comprise not more than 0.0.06% of dispersed silica and silicates.

It is also an object of the invention to provide such a composition that further includes fluorinated alkyl ester surfactant molecules. Their concentration can be selected to fall within a range from about 0.070 to about 0.13 parts per thousand.

In another embodiment, the fluorometallate anions include fluorozirconate anions, whose concentration is desirably within a range from about 4.5 to about 27 mM/kg; the concentration of chromium(III) cations may desirably be within a range from about 3.8 g/l to about 46 g/l; and the ratio of trivalent chromium to zirconium may desirably fall within the range of 12 to 22. Desirably, this composition further includes from about 0.070 to about 0.13 parts per thousand fluorinated alkyl ester surfactant molecules.

In an alternative embodiment, a composition for coating or touching-up or both coating and touching-up a metal surface is made by mixing together a first mass of water and at least the following components:

(A) a second mass of at least one water-soluble source of fluorometallate anions to provide in the composition from about 4.5 to about 27 mM/kg of the fluorometallate anions and mixtures thereof, each of the anions comprising:

(i) at least four fluorine atoms; and (ii) at least one atom of an element selected from the group consisting of titanium, zirconium, hafnium, silicon, aluminum, and boron, and, optionally, one or both of (iii) at least one ionizable hydrogen atom; and (iv) at least one oxygen atom; and (B) a third mass of a component to provide the composition with from about 3.8 g/l to about 46 g/l of trivalent chromium cations. In one aspect of this embodiment, the composition may comprise not more than 0.06% of dispersed silica and silicates.

It is also an object of the invention to provide a composition, wherein: the second mass comprises fluorozirconate anions in an amount that desirably corresponds to a concentration, in the composition, that is within a range from about 5.1 to about 24 mM/kg; and there is mixed into the composition a fourth mass of fluorinated alkyl ester surfactant molecules that desirably corresponds to a concentration, in the composition, that is within a range from about 0.070 to about 0.13 parts per thousand.

It is also an object of the invention to provide compositions wherein the source or third mass of trivalent chromium cations is selected from the group consisting of acetates, nitrates, sulfates, fluorides and chlorides of chromium (III).

Another aspect of the invention is a process for coating or touching-up or both coating and touching-up a surface, the surface comprising at least one area of bare metal, at least one area of coating over an underlying metal substrate, or both of at least one area of bare metal and at least one area of coating over an underlying metal substrate, the process comprising operations of:

(I) covering the surface to be coated, touched-up, or both coated and touched-up with a layer of a liquid composition as described herein; and (II) drying the liquid layer formed in operation (I) to form a coated surface, and optionally applying a paint or sealant.

Preferably, for reasons of economy and convenience, the coating of operation (I) is not rinsed prior to drying step (II). In one aspect of the process, the surface comprises at least one area of bare metal and at least one area of coating over an underlying metal substrate; and in operation (I), the liquid layer is formed over the at least one area of bare metal.

The liquid composition used in operation (I) may comprise fluorozirconate anions in a concentration range from about 4.5 to about 27 mM/kg, preferably from about 5.1 to about 24 mM/kg; the concentration of chromium(III) ions is greater than 0 g/l and can be up to the solubility limit of chromium in the solution, desirably the concentration is at least 3.0 g/l and not more than 46 g/l. The composition can further include a surfactant comprising fluorinated alkyl ester molecules in a concentration that is within a range from about 0.070 to about 0.13 parts per thousand; and optionally a concentration of hydrofluoric acid is present within a range from about 0.70 to about 1.3 parts per thousand.

In another embodiment of the process, the surface comprises at least one area of bare metal adjacent to at least one area of coating over an underlying metal substrate, the at least one area of coating over an underlying metal substrate comprising a first portion and a second portion, in operation (I), the liquid layer is formed over both the area of bare metal and at least the first portion of the adjacent area of coating over an underlying metal substrate; and the coating over an underlying metal substrate is selected from the group consisting of a phosphate conversion coating, a chromate conversion coating, and a conversion coating produced by contacting a surface consisting predominantly of iron, titanium, aluminum, magnesium and/or zinc and alloys thereof with an acidic treating solution comprising at least one of fluorosilicate, fluorotitanate, and fluorozirconate.

It is still another object of this invention to provide an article of manufacture having at least one portion that comprises a metal surface coated as described herein, desirably an aluminum or aluminum alloy metal surface and/or an anodized aluminum surface.

It is likewise an object of the invention to provide a coating that is dried-in-place on the metal surface, said coating comprising chromium in substantially only trivalent form and providing salt spray resistance of at least 96, 120, 144, 168, 192, 216, 240, 264, 288, 312, 336, 360, 408, 456, 480, 504 hours in corrosion testing according to ASTM B-117. Desirably surfaces coated according to the invention as described herein that are intended to be left unpainted will be selected from those coated surfaces that provide salt spray resistance of at least 336 hours. Coated surfaces that are intended to be subsequently painted or sealed may be selected from those coated surfaces that provide salt spray resistance of at least 96 hours.

It is also an object of the invention to provide processes for treating a metal surface to form a protective coating, or for treating a metal surface on which a protective coating has previously been formed and remains in place, with its protective qualities intact, on one part of the surface but is totally or partially absent from, or is present only in a damaged condition over, one or more other parts of the surface, so that its protective value in these areas of at least partial damage or absence has been diminished. (Usually the absence or damage of the initial protective coating has been unintentional and has occurred as a result of such events as imperfectly uniform formation of the initial protective coating, mechanical damage of the initial protective coating, spotty exposure of the initially coated surface to solvents for the initial protective coating, or the like. The absence or damage of the initial protective coating may be intentional, however, as when holes are drilled in a coated surface, for example, or when untreated parts are attached to and therefore become part of a previously coated surface.)

Particularly if the surface in question is large and the damaged or untreated area(s) are relatively small, it is often more economical to attempt to create or restore the full protective value of the original coating primarily in only the absent or damaged areas, without completely recoating the object. Such a process is generally known in the art, and will be briefly described herein, as "touching-up" the surface in question. This invention is particularly well suited to touching-up surfaces in which the original protective coating is a conversion coating initially formed on a primary metal surface, more particularly a primary metal surface consisting predominantly of iron, titanium, aluminum, magnesium and/or zinc and alloys thereof, this includes Galvalume and Galvaneal. One of skill in the art will understand "predominantly" as used herein to mean the predominant element is the one comprising the greatest amount by weight of the alloy.

An alternative or concurrent object of this invention is to provide a process for protectively coating metal surfaces that were never previously coated. Other concurrent or alternative objects are to achieve at least as good protective qualities in the touched-up areas as in those parts of the touched-up surfaces where the initial protective coating is present and undamaged; to avoid any damage to any pre-existing protective coating from contacting it with the touching-up composition; and to provide an economical touching-up process. Other objects will be apparent to those skilled in the art from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); the term "paint" includes all like materials that may be designated by more specialized terms such as primer, lacquer, enamel, varnish, shellac, topcoat, and the like; and the term "mole" and its variations may be applied to elemental, ionic, and any other chemical species defined by number and type of atoms present, as well as to compounds with well defined molecules.

DETAILED DESCRIPTION OF PREFERRED EMBODIMENTS

Corrosion resistant coatings, and compositions for depositing them, comprising hexavalent chromium alone or in combination with trivalent chromium, as well as coatings and baths comprising trivalent chromium that is oxidized to hexavalent chromium, in the bath or as part of the coating process are known. Heretofore, no trivalent chromium containing coating or coating bath has been developed that achieved adequate salt spray resistance for use on substrates that were not to be painted, unless hexavalent chromium was included in the coating. In particular, no trivalent chromium-containing coatings that have been dried-in-place on the substrate, as compared to trivalent chromium-containing coatings that are applied and then rinsed with water, have achieved salt spray resistance adequate for use on substrate that are to be left unpainted. Applicants have developed a hexavalent chromium-free, liquid composition that satisfies this unmet need. The composition is stable for more than 1000 hours, showing little or no precipitation of trivalent chromium compounds, and requires no post-rinsing of the substrate.

One embodiment of the present invention provides a liquid composition that comprises, preferably consists essentially of, or more preferably consists of, water and:

(A) a component of fluorometallate anions, each of said anions comprising, preferably consisting of:
  (i) at least four fluorine atoms; and
  (ii) at least one atom of an element selected from the group consisting of titanium, zirconium, hafnium, silicon, aluminum, and boron; and, optionally, one or both of
  (iii) at least one ionizable hydrogen atom; and
  (iv) at least one oxygen atom;
(B) a component of chromium(III) cations;

and, optionally, one or more of the following components:

(C) a component of free fluoride ions that are not part of any of immediately previously recited components (A) through (B);
(D) a component of surfactant molecules that are not part of any of immediately previously recited components (A) through (C);
(E) a pH adjusting component that is not part of any of the immediately previously recited components (A) through (D); and
(F) a viscosity increasing component that is not part of any of the immediately previously recited components (A) through (E).

It should be understood that alternatively, the components listed need not necessarily all be provided by separate chemicals. For example, HF may provide pH adjustment as well as free fluoride ions.

It has been found that excellent coating and/or touching-up quality, particularly for corrosion resistance on previously untreated areas and corrosion resistance in combination with a conversion coating, can be achieved by:

(I) covering the areas to be touched-up with a layer of the above described composition of the invention;

and subsequently (II) drying into place over the surface the liquid layer formed in step (I); the coated surfaces by subsequently be given an optional coating of paint or sealant.

The compositions of the invention have been developed as hexavalent chromium-free. Although not preferred, formulations according to the invention can be made including hexavalent chromium. Compositions according to the invention desirably contain less than 0.04, 0.02, 0.01, 0.001, 0.0001, 0.00001, 0.000001 percent by weight of hexavalent chromium, most preferably essentially no hexavalent chromium. The amount of hexavalent chromium present in the compositions of the invention is desirably minimized. Preferably only traces of hexavalent chromium are present in the composition and the deposited conversion coating, in amounts such as are found as trace elements in the raw materials used or in the substrates treated. Most preferably no hexavalent chromium is present.

It is known in the prior art to oxidize some of the trivalent chromium in a coating to form hexavalent chromium, see U.S. Pat. No. 5,304,257. In the present invention, it is desirable that the coatings formed by compositions, as dried-in-place, according to the invention contain hexavalent chromium only in the amounts as recited in the immediately preceding paragraph, that is, little or no hexavalent chromium. It will be understood by those of skill in the art that the invention includes coatings that as dried-in-place contain no hexavalent chromium but which may, due to subsequent exposure to weathering or other treatments, contain hexavalent chromium resulting from oxidation of the trivalent chromium in the coating.

In a preferred embodiment of the invention, the composition and the resulting dried-in-place coating are substantially free, desirably essentially free, of hexavalent chromium. More preferably, any hexavalent chromium is present in trace amounts or less, and most preferably the compositions contain no hexavalent chromium.

Various embodiments of the invention include processes for treating surfaces as described above, optionally in combination with other process steps that may be conventional per se, such as precleaning, rinsing, and subsequent further protective coatings over those formed according to the invention, compositions useful for treating surfaces as described above, and articles of manufacture including surfaces treated according to a process of the invention.

Independently of the concentration of Component (A), the fluorometallate anions preferably are fluorosilicate (i.e., $SiF_6^{-2}$), fluorotitanate (i.e., $TiF_6^{-2}$) and/or fluorozirconate (i.e., $ZrF_6^{-2}$), more preferably fluorotitanate or fluorozirconate, most preferably fluorozirconate.

In general a working composition for use in a process according to this invention desirably has a concentration of at least, with increasing preference in the order given, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3 millimoles of fluorometallate anions, component (A), per kilogram of total working composition, this unit of concentration being freely applicable hereinafter to any other constituent as well as to fluorometallate anions and being hereinafter usually abbreviated as "mM/kg". Independently, in a working composition, the concentration of fluorometallate ions preferably, at least for economy, is not more than, with increasing preference in the order given, 27.0, 26.0, 25.0, 24.0, 23.0, 22.0, 21.0, 20.0, 19.0, 18.5, 18.0, 17.5, 17.0, 16.5, 16.0, 15.5, 15.0, 14.5, 14.0, 13.5, 13.0, 12.5, 12.0, 11.5, 11.0, 10.9, 10.8, 10.7 mM/kg.

If the working composition is intended for use in a process in which at least two treatments according to the invention will be applied to the substrate, the concentration of fluorometallate anions still more preferably can be not more than, with increasing preference in the order given, 15, 12, 10, 8.0, 7.0, 6.5, 6.0, 5.5, or 5.1 mM/kg. In the event that only a single treatment with a composition according to the invention is desired, for maximum corrosion protection, the concentration of fluorometallate anions preferably is at least, with increasing preference in the order given, 9.0, 9.5, 9.7, 10.0, 10.5, 11.0, 11.5, 12.0, 12.5, 13.0, 13.5, 14.0, 15.0, 16.0, 17.0, 18.0, 19.0, 20.0, 21.0, 22.0, 23.0, or 24.0 mM/kg.

Desirably the cation for the fluorometallate anion selected from ions of Group IA elements, or ammonium ions. Preferably the cation is K or H, most preferably H.

Component (B) as defined above is to be understood as including one or more of the following sources of trivalent chromium cations: acetates, nitrates, sulfates, fluorides, and chlorides of chromium(III), and the like. In a preferred embodiment, Component (B) comprises, preferably consists essentially of, most preferably consists of trivalent chromium fluoride. The total concentration of trivalent chromium cations in a working composition according to the invention is preferably at least, with increasing preference in the order given, 3.8, 4.0, 4.5, 5.0, 5.5, 6.0, 6.5, 7.0, 7.5, 8.0, 8.5, 9.0, 9.5, 10, 10.5, 11, 11.5, 12, 12.5, 13, 13.5, 14, 14.3, 14.5, 14.7, 15, 15.5, 16, 16.5, 17, 17.5, 18, 18.5, 19, 19.5, 20, 21, 22, 23, 24, 25, 26, 27, 28, 29, 30, 31, 32, 33, 34, 35 g/l, and independently, primarily for reasons of economy, is preferably not more than, with increasing preference in the order given, 46, 45, 44, 43, 42, 41, 40, 39, 38, 37, 36 g/l.

A component of free fluoride ions (C) may optionally be provided, which may or may not be part of any of immediately previously recited components (A) through (B). This component may be supplied to the composition by hydrofluoric acid or any of its partially or completely neutralized salts that are sufficiently water soluble. At least for economy, component (C) is preferably supplied by aqueous hydrofluoric acid, and independently preferably is present in a concentration that is at least, with increasing preference in the order given, 0.10, 0.30, 0.50, 0.60, 0.70, 0.80, or 0.90 parts per thousand of its stoichiometric equivalent as HF. Independently, in a working composition to be used in a process according to the invention, the concentration of component (C), measured as its stoichiometric equivalent as HF, preferably is not more than, with increasing preference in the order given, 10, 8.0, 6.0, 4.0, 3.0, 2.0, 1.5, 1.3, or 1.1 parts per thousand. Suitable sources of free fluoride ions are known to those of skill in the art. Preferably, the source of (C) is HF.

Component (D), if used, is chosen from anionic surfactants, such as salts of carboxylic acids, alkylsulphonates, alkyl-substituted phenylsulphonates; nonionic surfactants, such as alkyl-substituted diphenylacetylenic alcohols and nonylphenol polyoxyethylenes; and cationic surfactants such as alkylammonium salts; all of these may and preferably do contain fluorine atoms bonded directly to carbon atoms in their molecules. Each molecule of a surfactant used preferably contains a hydrophobe portion that (i) is bonded by a continuous chain and/or ring of covalent bonds; (ii) contains a number of carbon atoms that is at least, with increasing preference in the order given, 10, 12, 14, or 16 and independently preferably is not more than, with increasing preference in the order given, 30, 26, 22, or 20; and (iii) contains no other atoms except hydrogen, halogen, and ether-bonded oxygen atoms. Component (D) is most preferably a non-ionic fluorosurfactant, such materials are known in the art and commercially available under the Zonyl® trade name from E.I. du Pont de Nemours and Company.

A working composition according to the invention may contain, with increasing preference in the order given, at least 0.010, 0.030, 0.050, 0.070, 0.080, 0.090, or 0.100 parts per thousand of component (D) and independently preferably, primarily for reasons of economy, contains not more than, with increasing preference in the order given, 5.0, 2.5, 1.30, 0.80, 0.60, 0.40, 0.30, 0.20, 0.18, 0.15, 0.13, or 0.11 parts per thousand of component (D).

The pH of a composition used according to the invention preferably is at least, with increasing preference in the order given, 2.10, 2.30, 2.50, 2.70, 2.90, 3.0, 3.10, 3.20, 3.30, 3.40, 3.50, 3.55, or 3.60 and independently preferably is not more than, with increasing preference in the order given, 5.0, 4.95, 4.90, 4.80, 4.70, 4.60, 4.50, 4.40, 4.30, 4.20, 4.10, 4.00, 3.90, 3.80, or 3.70. A pH adjusting component (E), which may or may not be part of any of the immediately previously recited components (A) through (D) can be added to the composition in an amount sufficient to produce a pH in the above-recited range, as necessary. A pH adjusting component may be any acid or a base, known in the art which does not interfere with the objects of the invention. In one embodiment, the pH adjuster is an acid, desirably HF, which also provides free fluoride ion (C). In another embodiment, the pH adjusting component comprises a base, and desirably is ammonium hydroxide.

Dilute compositions within these preferred ranges, that include the necessary active ingredients (A) through (B) only, may have inadequate viscosity to be self-supporting in the desired thickness for touching-up areas that can not be placed in a substantially horizontal position during treatment and drying; if so, one of the materials known in the art, such as natural gums, synthetic polymers, colloidal solids, or the like should be used as optional component (F), as is generally known in the art, unless sufficient viscosity is provided by one or more of other optional components of the composition. If the characteristic treatment composition is to be applied in a process according to the invention by use of a saturated felt or like material, component (F) is rarely needed and usually is preferably omitted, because most viscosity increasing agents are susceptible to being at least partially filtered out of the treatment composition by applicators of this type.

A working composition according to the invention may be applied to a metal workpiece and dried thereon by any convenient method, several of which will be readily apparent to those skilled in the art. For example, coating the metal with a liquid film may be accomplished by immersing the surface in a container of the liquid composition, spraying the composition on the surface, coating the surface by passing it between upper and lower rollers with the lower roller immersed in a container of the liquid composition, contact with a brush or felt saturated with the liquid treatment composition, and the like, or by a mixture of methods. Excessive amounts of the liquid composition that might otherwise remain on the surface prior to drying may be removed before drying by any convenient method, such as drainage under the influence of gravity, passing between rolls, and the like.

A particularly advantageous method of application of the treatment liquid in a process according to this invention makes use of an applicator as disclosed in U.S. Pat. Nos. 5,702,759 and 6,010,263 to White et al., the entire disclosure of which, except for any part that may be inconsistent with any explicit statement herein, is hereby incorporated herein by reference.

The temperature during application of the liquid composition may be any temperature within the liquid range of the composition, although for convenience and economy in application, normal room temperature, i.e., from 20-27° C. is usually preferred.

Application of compositions of the instant invention provide improved adhesive bonding to subsequently applied protective layers, such as paints, lacquers and other resin based coatings.

Preferably the amount of composition applied in a process according to this invention is chosen so as to result, after drying into place, in at least as good corrosion resistance for the parts of the surface treated according to the invention as in the parts of the same surface where the initial protective coating is present and a process according to the invention has not been applied. Ordinarily, for most common protective chromate conversion coatings as initial protective coatings, such protection will be achieved if the total add-on mass (after drying) of the coating applied in a process according to the invention is at least, with increasing preference in the order given, 0.005, 0.010, 0.015, 0.020, 0.025, 0.030, 0.035, 0.040, 0.045, 0.050, 0.055, or 0.060 grams per square meter of surface coated (hereinafter usually abbreviated as "$g/m^2$"). Independently, at least equal corrosion resistance ordinarily will be achieved even if the add-on mass is not, and therefore for reasons of economy the add-on mass preferably is not greater than, with increasing preference in the order given, 1.00, 0.70, 0.50, 0.30, 0.20, 0.15, 0.10, 0.090, 0.085, 0.080, or 0.075 $g/m^2$ The add-on mass of the protective film formed by a process according to the invention may be conveniently monitored and controlled by measuring the add-on weight or mass of the metal atoms in the anions of component (A) as defined above, or of chromium, except in the unusual instances when the initial protective coating and/or the underlying metal substrate contains the same metal element(s). The amount of these metal atoms may be measured by any of several conventional analytical techniques known to those skilled in the art. The most reliable measurements generally involve dissolving the coating from a known area of coated substrate and determining the content of the metal of interest in the resulting solution. The total add-on mass can then be calculated from the known relationship between the amount of the metal in component (A) and the total mass of the part of the total composition that remains after drying. However, this method is often impractical for use with this invention, because the area touched-up is not always precisely defined. A more practical alternative is generally provided by small area X-ray spectrographs that, after conventional calibration, directly measure the amount(s) per unit area of individual metallic element(s) present in a coating, free from almost all interferences except the same elements present in other coatings on, or in a thin layer near the surface of, the underlying metal surface itself.

The effectiveness of a treatment according to the invention appears to be affected by the total amounts of the active ingredients that are dried-in-place on each unit area of the treated surface, and on the nature of the active ingredients and their ratios to one another, rather than on the concentration of the acidic aqueous composition used. The speed of drying has not been observed to have any technical effect on the invention, although it may well be important for economic reasons. If practical in view of the size of the object treated and the size of the areas of the object to be treated, drying may be speeded by placement of the surface to be treated, either before or after application to the surface of a liquid composition in a process according to the invention, in an oven, use of radiative or microwave heating, or the like. If speed of treatment is desired, but placing the entire object in an oven is inconvenient, a portable source of hot air or radiation may be used in the touched-up area(s) only. In either instance, heating the surface before treatment is preferred over heating after treatment when practical, and prewarming temperatures up to at least 65° C. may be satisfactorily used. If ample time is available at acceptable economic cost, a liquid film applied according to this invention often may simply be allowed to dry spontaneously in the ambient atmosphere with equally good results insofar as the protective quality of the coating is concerned. Suitable methods for each circumstance will be readily apparent to those skilled in the art.

Preferably, the surface to be treated according to the invention is first cleaned of any contaminants, particularly organic contaminants and foreign metal fines and/or inclusions. Such cleaning may be accomplished by methods known to those skilled in the art and adapted to the particular type of substrate to be treated. For example, for galvanized steel surfaces, the substrate is most preferably cleaned with a conventional hot alkaline cleaner, then rinsed with hot water and dried. For aluminum, the surface to be treated most preferably is first contacted with a conventional hot alkaline cleaner, then rinsed in hot water, then, optionally, contacted with a neutralizing acid rinse and/or deoxidized, before being contacted with an acid aqueous composition as described above. Ordinarily, cleaning methods suitable for the underlying metals will also be satisfactory for any part of the initial protective coating that is also coated in a process according to the invention, but care should be taken to choose a cleaning method and composition that do not themselves damage the protective qualities of the initial protective coating in areas that are not to be touched-up. If the initial protective coating is thick enough, the surface can be satisfactorily cleaned by physically abrading, as with sandpaper or another abrasive, the area(s) to be touched-up and any desired overlap zone where the initial protective coating is still in place around the damaged areas to be touched-up. The swarf may then be removed by blowing, brushing, rinsing, or with attachment to a cleaning tool, such as a moist cloth. It has been found that, when dry abrasion is used as the last preparatory cleaning method, the corrosion resistance of the coating usually will be less than optimal and the coating will appear smutty. However, dry abrasion followed by wiping, e.g. with a clean cloth, or rinsing is a satisfactory and often preferred cleaning method. One indication that the surface is sufficiently clean is that a film of water sprayed on the surface will dry without beading. A preferred process is abrasion using a Scotch-Brite™ pad, commercially available from 3M Corporation, or similar abrasive material, followed by wiping with a clean "Chem Wipe", commercially available from Henkel Corporation, followed by application of the invention.

After the preparatory cleaning, the surface may be dried by absorption of the cleaning fluid, evaporation, or any suitable method known to those skilled in the art. Corrosion resistance is usually less than optimal when there is a delay between the preparatory cleaning, or cleaning and drying, and the coating of the surface. The time between cleaning, or cleaning and drying, and coating the surface should be no more than, in increasing order of preference, 48, 24, 12, 6.0, 5.0, 4.0, 3.0, 2.0, 1.0, 0.50, 0.25, or 0.1 hours.

Usually, it is preferable, as a precaution during a touch-up process according to the invention, to apply the composition used for touching-up not only to obviously bare metal or obviously damaged areas of the initial protective coating, but also over a transition or overlap zone of apparently undamaged initial protective coating adjacent to such areas that obviously need touching-up. With increasing preference in the order given, such a transition zone has a width that is at least 0.2, 0.5, 0.7, 1.0, 1.5, or 2.0 millimeters and independently preferably, primarily for reasons of economy, is not more than, with increasing preference in the order given, 25, 20, 15, 10, 8.0, 6.0, 5.0, or 3.0 millimeters.

Virtually any kind of initial protective coating can be touched-up effectively for many purposes by a process according to this invention. In particular, but without limitation, conversion coatings produced on underlying metal according to the teachings of any one of the following U.S. patents, the disclosures of all of which, except to any extent that they may be inconsistent with any explicit statement herein, are hereby incorporated herein by reference, may be effectively touched-up by a process according to this invention: U.S. Pat. No. 5,769,667 of Jun. 23, 1998 to Dolan; U.S. Pat. No. 5,700,334 of Dec. 23, 1997 to Ishii et at; U.S. Pat. No. 5,645,650 of Jul. 8, 1997 to Ishizaki et al.; U.S. Pat. No. 5,683,816 of Nov. 4, 1997 to Goodreau; U.S. Pat. No. 5,595,611 of Jan. 21, 1997 to Boulos et al.; U.S. Pat. No. 5,551,994 of Sep. 3, 1996 to Schriever; U.S. Pat. No. 5,534,082 of Jul. 9, 1996 to Dollman et al.; U.S. Pat. No. 5,507,084 of Apr. 16, 1996 to Ogino et al.; U.S. Pat. No. 5,498,759 of Mar. 12, 1996 to Nakada et al.; U.S. Pat. No. 5,498,300 of Mar. 12, 1996 to Aoki et al.; U.S. Pat. No. 5,487,949 of Jan. 30, 1996 to Schriever, U.S. Pat. No. 5,472,524 of Dec. 5, 1995; U.S. Pat. No. 5,472,522 of Dec. 5, 1995 to Kawaguchi et at; U.S. Pat. No. 5,452,884 of Oct. 3, 1995; U.S. Pat. No. 5,451,271 of Sep. 19, 1995 to Yoshida et al.; U.S. Pat. No. 5,449,415 of Sep. 19, 1995 to Dolan; U.S. Pat. No. 5,449,414 of Sep. 12, 1995 to Dolan; U.S. Pat. No. 5,427,632 of Jun. 27, 1995 to Dolan; U.S. Pat. No. 5,415,687 of May 16, 1995 to Schriever; U.S. Pat. No. 5,411,606 of May 2, 1995 to Schriever; U.S. Pat. No. 5,399,209 of Mar. 21, 1995 to Suda et al.; U.S. Pat. No. 5,395,655 of Mar. 7, 1995 to Kazuyuki et al.; U.S. Pat. No. 5,391,239 of Feb. 21, 1995 to Boulos; U.S. Pat. No. 5,378,392 of Jan. 3, 1995 to Miller et al.; U.S. Pat. No. 5,366,567 of Nov. 22, 1994 to Ogino et al.; U.S. Pat. No. 5,356,490 of Oct. 18, 1994 to Dolan et al.; U.S. Pat. No. 5,342,556 of Aug. 30, 1994 to Dolan; U.S. Pat. No. 5,318,640 of Jun. 7, 1994 to Ishii et al.; U.S. Pat. No. 5,298,092 of Mar. 29, 1994 to Schriever; U.S. Pat. No. 5,281,282 of Jan. 25, 1994 to Dolan et al.; U.S. Pat. No. 5,268,042 of Dec. 7, 1993 to Carlson; U.S. Pat. No. 5,261,973 of Nov. 16, 1993 to Sienkowski et al.; U.S. Pat. No. 5,242,714 of Sep. 7, 1993 to Steele et al.; U.S. Pat. No. 5,143,562 of Sep. 1, 1992 to Boulos; U.S. Pat. No. 5,141,575 of Aug. 25, 1992 to Yoshitake et al.; U.S. Pat. No. 5,125,989 of Jun. 30, 1992 to Hallman; U.S. Pat. No. 5,091,023 of Feb. 25, 1992 to Saeki et al.; U.S. Pat. No. 5,089,064 of Feb. 18, 1992 to Reghi; U.S. Pat. No. 5,082,511 of Jun. 21, 1992 to Farina et al.; U.S. Pat. No. 5,073,196 of Dec. 17, 1991; U.S. Pat. No. 5,045,130 of Sep. 3, 1991 to Gosset et al.; U.S. Pat. No. 5,000,799 of Mar. 19, 1991 to Miyawaki; U.S. Pat. No. 4,992,196 of Feb. 13, 1991 to Hallman.

A process according to this invention is particularly advantageously applied to touching-up a surface in which the undamaged parts are protected by a coating selected from the group consisting of a phosphate conversion coating, a chromate conversion coating, and a conversion coating produced by contacting a predominantly aluminiferous or a predominantly zinciferous surface with an acidic treating solution comprising at least one of fluorosilicate, fluorotitanate, and fluorozirconate.

In addition, of course, metal surfaces with any other type of previously applied protective coating or without any previous deliberately applied coating can be coated in a process according to the invention.

The practice of this invention may be further appreciated by consideration of the following, non-limiting, working examples.

EXAMPLES

Example 1

Three compositions containing different concentrations of trivalent chromium were made according to Table 1. An amount of chromium (III) fluoride, as recited in Table 1 for each respective formula, was added to 160° F. water and mixed until dissolved completely. The solution was cooled to room temperature and fluorozirconic acid added. The pH was 2.7 and was adjusted to pH 4 by addition of ammonium hydroxide.

TABLE 1

| | Amount (g/liter) | | |
|---|---|---|---|
| Component | Formula A | Formula B | Formula C |
| $CrF_3$—$4H_2O$ | 15.5 | 31.0 | 46.5 |
| Fluorozirconic acid, 45% | 2.22 | 4.44 | 6.66 |
| Distilled water | Remainder | Remainder | Remainder |

Two commercially available, 2024 T3 bare aluminum panels for each formula were abraded with a Scotch-Brite™ pad until surface oxidation was removed. A total of six panels were treated, two for each composition in Table 1. Each panel received two coats (one applied horizontally and one applied vertically) with a 50% overlap of parallel applications lines, meaning all surfaces received at least two layers of treatment. The panels were allowed to dry without rinsing and cured for 3 days at ambient temperature and humidity. All panels were exposed to 168 hours salt spray testing according to ASTM B117. Formula A panels pitted at 75 pits for each 3×6 inch panel. Formula B had one panel with no pits and one panel with 3 pits. Formula C showed no pitting but showed black and dark grey staining.

Benchmarking

Formula A, as modified in Table 1A, was compared for performance in a dry-in-place application with two products according to the prior art.

Formula 1, a hexavalent chromium-containing composition formulated for dry-in-place use; Formula 2, a hexavalent chromium-free, trivalent chromium-containing composition useful for coating operations where the substrate is rinsed after contact with the coating composition, both commercially available from Henkel Corporation; and Formula A were compared for performance as dried-in-place coatings.

TABLE 1A

| | Amount (g/liter) | | |
|---|---|---|---|
| Component | Formula 1 | Formula A | Formula 2 |
| Chromic Acid Flake | 8.56 | | |
| $CrF_3$—$4H_2O$ | | 15.5 | |
| $CrOHSO_4$ 35% | | | 4.45 |
| Phosphoric Acid 75% | 1.00 | | |
| Thickener | 0.94 | 0.94 | |
| Surfactant | 0.10 | 0.10 | |
| Fluorozirconic Acid, 40% | 2.22 | | 5.48 |
| Fluorozirconic Acid, 45% | | 2.22 | |
| Liquid Caustic Potash 45% | | | 3.62 |
| Distilled water | Remainder | Remainder | Remainder |

The coating and salt spray testing procedure of Example 1 was used for all three compositions. In the ASTM salt spray test, Formula A performed better than Formula 2, the trivalent chromium-containing formula useful for coat-then-rinse applications, but not as well as Formula 1, the hexavalent chromium-containing composition formulated for dry-in-place use.

Example 2

Formula B from Example 1 was applied to 6 additional panels that had been abraded with a Scotch-Brite™ pad until surface oxidation was removed. Formula B was applied to the panels as shown in Table 2, with coats 1 and 3 applied vertically and coat 2 applied horizontally, that is transverse to the direction of application of coats 1 and 3. The treated panels were exposed to salt spray testing for 336 hours according to ASTM B117. The results are recited in Table 2:

TABLE 2

| Panel Number | Amount of Coating | Number of Coats | Results 336 hours Salt Spray |
|---|---|---|---|
| 1 | Heavy | 1 | No pits |
| 2 | Light | 1 | No pits |
| 3 | Heavy | 2 | No pits |
| 4 | Light | 2 | No pits; rundown from salt spray markings |
| 5 | Heavy | 3 | No pits; rundown from salt spray markings |
| 6 | Light | 3 | No pits; rundown from salt spray markings |

Example 3

A composition according to the invention was made as recited in Table 3:

TABLE 3

| Component | Amount (g) |
|---|---|
| Distilled water | 3854.08 |
| $CrF_3$—$4H_2O$ | 124.00 |
| Fluorozirconic acid, 45% | 17.76 |
| Total | 3995.84 |

The composition was pH adjusted to pH 4 by addition of ammonium hydroxide.

Panels of the following materials were obtained from aerospace supplier, Kaiser: 2024 aluminum, 6061 aluminum, 7075 aluminum. Five panels of each material were abraded with a Scotch-Brite™ pad until surface oxidation was removed. The panels were treated with the composition of Table 3, which had been prepared according to the method recited in Example 1. Each panel received two coats with a 50% overlap, meaning all surfaces received at least two layers of treatment, one in a vertical direction and one in a horizontal direction. All panels were exposed to salt spray testing according to ASTM B117. All five 2024 aluminum panels passed the 336 hours salt spray test with no pitting. All five panels of the 6061 aluminum passed the 336 hours salt spray test with no pitting. For the 7075 aluminum, three panels passed 336 hours salt spray with no pits. Two panels had minor edge pitting, but still passed the corrosion test.

Example 4

A composition according to the invention was made as recited in Example 3. Panels of the following materials were obtained from aerospace supplier, Kaiser: 2024-T3 aluminum, 6061 aluminum, and 7075 aluminum, as well as 2024-T3 Clad and 7075 Clad aluminum. The panels were treated according to the procedure of Example 3. The results of ASTM B117 salt spray testing for these panels is shown in Table 4.

TABLE 4

| 336 Hours Salt Spray (ASTM B117) Test | | | |
|---|---|---|---|
| | Panel Number | | |
| Alloy Material and Cladding | 1 | 2 | 3 |
| 2024-T3 Clad | 0 pits | 0 pits | 0 pits |
| 7075 Clad | 0 pits | 0 pits | 0 pits |
| 2024-T3 Bare | 0 pits | 0 pits | 0 pits |
| 6061 Bare | 0 pits | 0 pits | 0 pits |
| 7075 Bare | 0 pits | 0 pits | 0 pits |

Example 5

A composition according to the invention was made as recited in Example 3. Two panels of 2024-T3 aluminum were coated with Alodine® 1600, a hexavalent chromium containing conversion coating commercially available from Henkel Corporation, according to Henkel Technical Process Bulletin No. 236149. Two different panels of 2024-T3 aluminum were coated with Formula 2, a trivalent chromium-containing conversion coating commercially available from Henkel Corporation, and rinsed, according to Henkel Technical Process Bulletin No. 239583. The panels were allowed to cure for the time period recited in Table 5, and were then touched-up with the composition according to Example 3. The panels received two coats with a 50% overlap, meaning all surfaces received at least two layers of treatment, one in a vertical direction and one in a horizontal direction. All panels were then exposed to salt spray testing according to ASTM B117, with results as shown in Table 5.

TABLE 5

336 hour Salt Spray Resistance after Touch-up over existing coating

| Alloy Material | Existing Coating | Panel Number 1 | Panel Number 2 | Time between original coating and touch-up application |
|---|---|---|---|---|
| 2024-T3 Bare | Alodine ® 1600 | 0 pits | 0 pits | 2 hours |
| 2024-T3 Bare | Formula 2 | 0 pits | 0 pits | 2 hours |
| 2024-T3 Bare | Alodine ® 1600 | 0 pits | 0 pits | 2 weeks |
| 2024-T3 Bare | Formula 2 | 0 pits | 0 pits | 2 weeks |

Example 6

A composition according to the invention was made as recited in Example 3. Panels of 2024-T3 aluminum were treated according to the procedure of Example 3, but the type of abrasive material was varied as was the method of mechanical abrasion. Green Scotch Brite™ Pads are described by the manufacturer as Scotch Brite™ General Purpose Scouring Pad No. 96; yellow Scotch Brite™ Pads are described by the manufacturer as Scotch Brite™ Clear Blend Prep Scuff N. 051131-07745. Electrical orbital sanders were those typically used in the aerospace industry as is known by those of skill in the art. All panels were abraded for 3 minutes and wiped to remove debris, prior to coating with the composition of Example 3. All panels were then exposed to salt spray testing according to ASTM B117, with results as shown in Table 6.

TABLE 6

336 hour Salt Spray Resistance Unaffected by varying Scotch Brite ™ Method

| Alloy Material | Type of Scotch Brite ™ Pad Used | Method of Mechanical Abrasion | Panel Number 1 | Panel Number 2 |
|---|---|---|---|---|
| 2024-T3 Bare | Green | Electric Orbital Sander | 0 pits | 0 pits |
| 2024-T3 Bare | Yellow | Electric Orbital Sander | 0 pits | 0 pits |
| 2024-T3 Bare | Green | Manually Hand Sand | 0 pits | 0 pits |
| 2024-T3 Bare | Yellow | Manually Hand Sand | 0 pits | 0 pits |

Example 7

A composition according to the invention was made and applied to panels of 6061 aluminum as recited in Example 3. Each panel was given one or two coats of the composition and then allowed to cure as recited in Table 7. The resistivity of the coated surface was measured in milliohms according to Mil-DTL-81706B with the following results:

TABLE 7

Electrical Resistance on 6061 Bare per Military Specification: Mil-DTL-81706B

| Number of coats | Cure Time (days) | Resistivity (milliohms) |
|---|---|---|
| 1 | 1 | 1.19 |
| 2 | 1 | 0.45 |
| 1 | 3 | 1.3 |
| 2 | 3 | 0.9 |

The invention claimed is:

1. A composition for coating or touching-up or both coating and touching-up a metal surface, said composition comprising water and:

(A) from about 4.5 millimoles per kilogram to about 27 millimoles per kilogram of a component of fluorometallate anions and mixtures of fluorometallate anions, each of said anions comprising:

(i) at least four fluorine atoms; and (ii) at least one atom of an element selected from the group consisting of titanium, zirconium, hafnium, silicon, aluminum, and boron, and, optionally, one or both of (iii) at least one ionizable hydrogen atom; and (iv) at least one oxygen atom;

(B) at least 6.5 g/l to about 46 g/l of trivalent chromium cations;

said composition being substantially free of hexavalent chromium.

2. The composition according to claim 1, wherein the fluorometallate anions are selected from the group consisting of fluorosilicate, fluorotitanate, and fluorozirconate anions, and mixtures thereof.

3. The composition according to claim 1, wherein the fluorometallate anions include fluorozirconate anions in a concentration within a range from about 5.1 to about 24 mM/kg; said liquid composition comprising not more than 0.06% of dispersed silica and silicates.

4. The composition according to claim 3 which contains substantially no zinc.

5. The composition according to claim 1, wherein:

the fluorometallate anions include fluorozirconate anions at a concentration within a range from about 5.1 to about 24 mM/kg;

the concentration of chromium(III) cations is within a range from about 7.5 g/l to about 46 g/l; and the ratio of trivalent chromium to zirconium is in the range of 12 to 22.

6. The composition according to claim 5 which further includes from about 0.070 to about 0.13 parts per thousand fluorinated alkyl ester surfactant molecules.

7. The composition according to claim 1, wherein the trivalent chromium cations are sourced from the group consisting of fluorides and chlorides of chromium (III).

8. The composition according to claim 7, wherein component (A) is present as hexafluorozirconic acid and component (B) is sourced as 31.0 to 46.0 g/l $CrF_3 \times 4H_2O$.

9. A process for coating or touching-up or both coating and touching-up a surface, said surface comprising at least one area of bare metal, at least one area of coating over an underlying metal substrate, or both of at least one area of bare metal and at least one area of coating over an underlying metal substrate, said process comprising operations of:

(I) covering the surface to be coated, touched-up, or both coated and touched-up with a layer of a liquid composition of claim 1; and (II) drying into place the liquid layer formed in operation (I) to form a coated surface without rinsing between operation (I) and said drying.

10. The process according to claim 9, wherein the surface comprises at least one area of bare metal and at least one area of coating over an underlying metal substrate; and in operation (I), the liquid layer is formed over the at least one area of bare metal.

11. The process according to claim 9, wherein, in said liquid composition used in operation (I):

the fluorometallate anions are selected from the group consisting of fluorosilicate, fluorotitanate, and fluorozirconate anions, and mixtures thereof.

12. The process according to claim 11, wherein, in the liquid composition used in operation (I):

the fluorometallate anions include fluorozirconate anions in a concentration within a range from about 5.1 to about 24 mM/kg;

the concentration of chromium(III) ions is at least 7.0 g/l and not more than 46 g/l;

a concentration of hydrofluoric acid is present within a range from about 0.70 to about 1.3 parts per thousand; and the composition includes fluorinated alkyl ester surfactant molecules in a concentration that is within a range from about 0.070 to about 0.13 parts per thousand.

13. The process according to claim 9, wherein, in said liquid composition used in operation (I):

the fluorometallate anions include fluorozirconate anions in a concentration range from about 4.5 to about 27 mM/kg;

the concentration of chromium(III) ions is at least 7.0 g/l and not more than 46 g/l; and the composition further includes a surfactant comprising fluorinated alkyl ester molecules in a concentration that is within a range from about 0.070 to about 0.13 parts per thousand.

14. The process according to claim 13, wherein:

the surface comprises at least one area of bare metal adjacent to at least one area of coating over an underlying metal substrate, said at least one area of coating over an underlying metal substrate comprising a first portion and a second portion, in operation (I), the liquid layer is formed over both the area of bare metal and at least the first portion of said adjacent area of coating over an underlying metal substrate; and the coating over an underlying metal substrate is selected from the group consisting of a phosphate conversion coating, a chromate conversion coating, and a conversion coating produced by contacting a surface consisting predominantly of iron, titanium, aluminum, magnesium and/or zinc and alloys thereof with an acidic treating solution comprising at least one of fluorosilicate, fluorotitanate, and fluorozirconate.

15. An article of manufacture having at least one portion that comprises the coated surface of claim 9.

16. The article of manufacture of claim 15 wherein the at least one portion comprises aluminum, aluminum alloy or anodized aluminum and passes ASTM B117 salt spray testing of 336 hours with no pits.

17. A composition for coating or touching-up or both coating and touching-up a metal surface, said composition being made by mixing together a first mass of water and at least the following components:

(A) a second mass of at least one water-soluble source of fluorometallate anions to provide in the composition from about 4.5 to about 27 mM/kg of the fluorometallate anions and mixtures thereof, each of said anions comprising:

(i) at least four fluorine atoms; and (ii) at least one atom of an element selected from the group consisting of titanium, zirconium, hafnium, silicon, aluminum, and boron, and, optionally, one or both of (iii) at least one ionizable hydrogen atom; and (iv) at least one oxygen atom;

(B) a third mass of a component to provide the composition with from about 3.8 g/l to about 46 g/l of trivalent chromium cations;

wherein the composition comprises less than 0.04 wt % hexavalent chromium cations and said at least one water-soluble source of fluorometallate anions comprises fluorozirconic acid;

said composition further comprising fourth mass of a pH adjusting component that is ammonium hydroxide, the ratio of trivalent chromium to zirconium being in the range of 12 to 22.

18. The composition according to claim 17, wherein the third mass of a component is selected from the group consisting of fluorides and chlorides of chromium (III).

* * * * *